US006644070B2

(12) United States Patent
Ikenaga et al.

(10) Patent No.: US 6,644,070 B2
(45) Date of Patent: Nov. 11, 2003

(54) THREE-DIMENSIONAL FABRIC FOR SEAT

(75) Inventors: Hideo Ikenaga, Kyoto (JP); Kenji Hamamatsu, Hirakata (JP); Toshiaki Kawano, Ibaraki (JP)

(73) Assignee: Asahi Kasei Kabushiki Kaisha, Osaka (JP)

( * ) Notice: Subject to any disclaimer, the term of this patent is extended or adjusted under 35 U.S.C. 154(b) by 0 days.

(21) Appl. No.: 10/107,301

(22) Filed: Mar. 28, 2002

(65) Prior Publication Data

US 2003/0033838 A1 Feb. 20, 2003

(30) Foreign Application Priority Data

Mar. 29, 2001 (JP) ..... 2001-096126
May 25, 2001 (JP) ..... 2001-157723
May 16, 2001 (JP) ..... 2001-146914

(51) Int. Cl.[7] ..... D04B 7/12

(52) U.S. Cl. ..... 66/196; 66/202; 66/169 R; 442/318

(58) Field of Search ..... 66/169 R, 170, 66/171, 190, 191, 192, 193, 195, 196, 202; 442/312, 313, 314, 318

(56) References Cited

U.S. PATENT DOCUMENTS 4,280,342 A * 7/1981 Eng et al. ..... 66/196
4,785,558 A * 11/1988 Shiomura ..... 66/196
4,787,219 A * 11/1988 Sato et al. ..... 66/190
5,385,036 A * 1/1995 Spillane et al. ..... 66/196
5,395,684 A * 3/1995 Robinson et al. ..... 442/312
5,422,153 A * 6/1995 Miyamoto ..... 66/196
5,651,847 A * 7/1997 Loeffler ..... 66/196
5,735,145 A * 4/1998 Pernick ..... 66/196
6,105,401 A * 8/2000 Chadeyron et al. ..... 66/195
6,399,523 B1 * 6/2002 Matsumoto ..... 66/195

FOREIGN PATENT DOCUMENTS

JP 02074648 A 3/1990
JP 02229247 A 9/1990
JP 11783/92 3/1992
JP 09273050 A 10/1997
JP 10131008 A 5/1998
JP 11269747 A 10/1999

* cited by examiner

*Primary Examiner*—Danny Worrell
(74) *Attorney, Agent, or Firm*—Finnegan, Henderson, Farabow, Garrett & Dunner, L.L.P.

(57) ABSTRACT

A three-dimensional knit fabric having front and back knit layers and a monofilament yarn connecting the knit layers to each other, characterized in that the curvature of the monofilament yarn in the three-dimensional knit fabric is in a range from 0.01 to 1.6, and the bending elongation of the monofilament is 20% or less when the three-dimensional knit fabric is compressed to 50%. The three-dimensional knit fabric has a cushioning property in springiness which does not deteriorate even if the fabric is repeatedly used many times or for a long time, and thus this fabric is excellent in terms of durability of the cushioning property. In particular, the fabric is suitable for use as a hammock type seat and exhibits a cushioning property having a favorable springy feeling as well as a good fit feel.

16 Claims, 3 Drawing Sheets

THREE-DIMENSIONAL FABRIC FOR SEAT

TECHNICAL FIELD OF THE INVENTION

The present invention relates to a three-dimensional knit fabric suitable for use as a cushion for a seat of a car, a railway train, an airplane, a baby car, a domestic or office chair; a cushion for a bed pad, a mattress, an anti-bedsore mat, a pillow or a kneeling mat; a spacer for a clothing; a shape-retainer; a shock absorber; a thermal insulator; an upper material or insole of shoes; or a supporter or a protector.

BACKGROUND ART

Three-dimensional knit fabrics consisting of front and back knit layers connected to each other with a connecting yarn have been used in various fields as cushion material because of their favorable functions such as cushioning property, air-permeability, thermal insulation property or body-weight dispersion property.

The cushioning property is exhibited in the thickness direction of the three-dimensional knit fabric by using a monofilament yarn rich in bending elasticity as the connecting yarn constituting an intermediate layer. Japanese Unexamined Patent Publication (Kokai) No. 11-269747 discloses a three-dimensional knit fabric excellent in compression recovery obtained by using a monofilament yarn having favorable elastic recovery as a connecting yarn. This fabric, however, lacks a cushioning property rich in elastic feeling because the configuration of the monofilament yarn used as a connecting yarn has not been taken into account, and also has a problem in that the elastic feeling becomes inferior and the fabric thickness reduces as the fabric is used repeatedly or for a long time. Further, since the elongation characteristic and the compressive deformation of front and back knit layers of the three-dimensional knit fabric are not taken into account, a favorable cushioning property is not obtainable when the fabric is used for a hammock type seat. In Japanese Unexamined Patent Publication (Kokai) No. 2001-87077, a hammock type seat is disclosed, in which a three-dimensional knit fabric is mounted onto a seat frame in a stretched state. This seat, however, exhibits insufficient durability of its cushioning property when used repeatedly.

An object of the present invention is to solve the above-mentioned problems in the prior art and provide a three-dimensional knit fabric having a cushioning property rich in elastic feeling which does not deteriorate if the fabric is used repeatedly or for a long time. A more concrete object of the present invention is to provide a three-dimensional knit fabric suitable for use as a hammock type seat, which exhibits a cushioning property in excellent bounsiness feel and fits the human body, as well as a favorable shape-retaining property not causing a so-called deformation or depression, which is a phenomenon wherein the seat is not restorable to its original shape after a user has sat on it.

SUMMARY OF THE INVENTION

DISCLOSURE OF THE INVENTION

The present inventor conceived of the present invention after diligent study on the diameter and curved configuration of a monofilament yarn connecting front and back knit layers of a three-dimensional knit fabric, the compressive property and compressive deformation of the three-dimensional knit fabric, and the structure of the three-dimensional knit fabric constituted by combining various fibrous materials.

Specifically, the present invention is a three-dimensional knit fabric consisting of front and back knit layers and a monofilament yarn connecting the knit layers with each other, characterized in that the curvature of the monofilament yarn in the three-dimensional knit fabric is in a range from 0.01 to 1.6, and the bending elongation of the monofilament yarn is 20% or less when the three-dimensional knit fabric is compressed to 50%.

BRIEF DESCRIPTION OF THE INVENTION

The present invention will be described in more detail with reference to the attached drawings, of which FIG. 1 is a sectional view of a three-dimensional knit fabric taken along a wale thereof, illustrating a center line of a monofilament yarn;

DETAILED DESCRIPTION OF THE INVENTION

In the following the invention will be explained in detail.

When a three-dimensional knit fabric is knitted by a double raschel machine, a double circular knitting machine or a flat bed knitting machine, a connecting yarn for connecting front and back knit layers with each other is always incorporated into the knit fabric to be knitted in a state curved to either directions. Accordingly, when a force is applied to the three-dimensional knit fabric in the thickness direction thereof, the already bent connecting yarn bends further, and when the force is released, the connecting yarn restores itself to its original state. The behavior of the bending and the restoration of the connecting yarn at this time strongly influences the cushioning property of the three-dimensional knit fabric. The present invention has been made on the basis of this fact.

Figure 1:
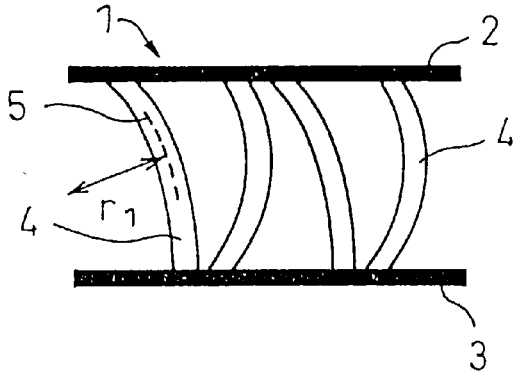

The three-dimensional knit fabric of the present invention necessarily uses a monofilament yarn as at least part of a connecting yarn for connecting front and back knit layers with each other and must be knit and finished so that the monofilament yarn interposed between the front and back knit layers has a curvature in a range from 0.01 to 1.6. In this respect, the curvature of the monofilament yarn referred to in this text is the curvature of an arc defined by a center line of the monofilament yarn in a maximally curved region within the three-dimensional knit fabric. In FIG. 1, an example of a center line 5 of the monofilament yarn is illustrated, as seen in a cross-section of the three-dimensional knit fabric 1 taken along a wale thereof. The curvature of the monofilament yarn is preferably in a range from 0.03 to 1.0, more preferably from 0.05 to 0.7. If the curvature of the monofilament yarn is less than 0.01, a shearing deformation in which the front and back knit layers are shifted in the lengthwise direction of the three-dimensional knit fabric is liable to occur when a load is applied to the three-dimensional knit fabric 1 in the thickness direction thereof, whereby a hysteresis loss becomes large during the restoration from the compression, resulting in the cushioning property lacking elastic feel. Also, such a tendency increases as the compression is repeated. Contrarily, if the curvature (r1) of the monofilament yarn exceeds 1.6, the shearing deformation is improved, but the cushioning property lacks elastic feeling as well.

Figure 2:
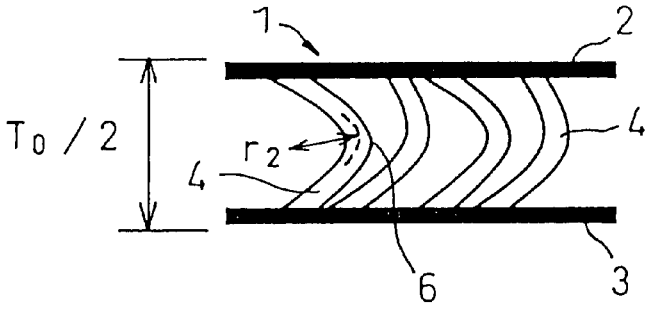
FIG. 2 is a sectional view of a three-dimensional knit fabric taken along a wale thereof, illustrating a curved monofilament yarn when the three-dimensional knit fabric is compressed to 50%.

The three-dimensional knit fabric of the present invention preferably has a monofilament yarn bending elongation of 20% or less when the three-dimensional knit fabric is compressed to 50%. This value is more preferably 15% or less, most preferably 10% or less. In this respect, the bending elongation is the elongation of a convex surface of the monofilament yarn in the maximally bending region thereof when the three-dimensional knit fabric is compressed to 50%. In FIG. 2, which is a sectional view of the three-dimensional knit fabric compressed to 50%, taken along a wale thereof, one example of the maximally bending convex surface 6 of the monofilament yarn is illustrated. If the bending elongation of the monofilament yarn exceeds 20%, the residual strain becomes high after the three-dimensional knit fabric has been compressed, resulting in a three-dimensional knit fabric having inferior compression recovery which cannot maintain a cushioning property having elastic feeling after repeated and/or a long-term use.

The bending elongation of the monofilament yarn of the three-dimensional knit fabric is more preferably 20% or less when the fabric is compressed to 75%, in view of improved compression recovery and durability of the cushioning property.

Figure 3:
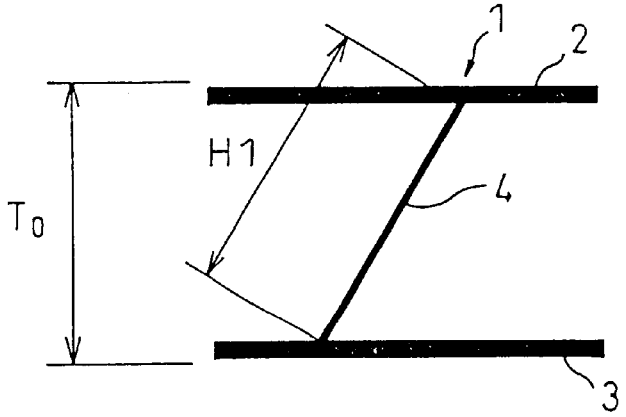
FIG. 3 is a sectional view of a three-dimensional knit fabric taken along a course thereof.
Figure 4:
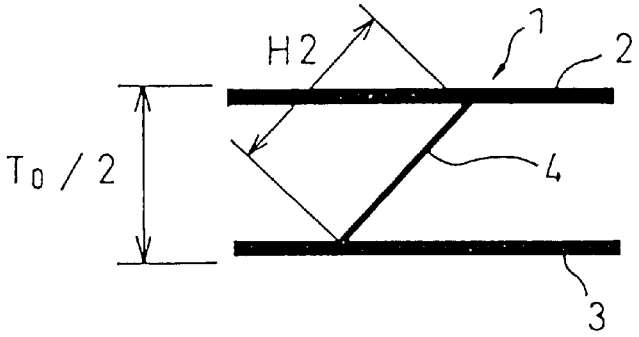
FIG. 4 is a sectional view of a three-dimensional knit fabric taken along a course thereof when the three-dimensional knit fabric is compressed to 50%.

To maintain the curvature of the monofilament yarn in the three-dimensional knit fabric and the bending elongation of the monofilament yarn at 50% compression in the above-mentioned proper range, it is necessary to optimize the thickness of the three-dimensional knit fabric 1, the diameter of the used monofilament yarn, the knitting stitch of the monofilament yarn in the three-dimensional knit fabric (the amount of movement of the monofilament yarn in the widthwise direction of the fabric when the front and back knit layers are connected), the feed rate of the monofilament yarn during the knitting operation and the method for finishing the three-dimensional knit fabric (the width widening ratio or overfeed ratio) so that the monofilament yarn has a proper configuration after being finished. Of the above factors, the relationship between the knitting stitch of the monofilament yarn and the thickness of the three-dimensional knit fabric is most important. More specifically, the connecting yarn is slanted relative to the widthwise direction (along the course) of the knit fabric to connect the front and back knit layers with each other, and the three-dimensional knit fabric is finished so as to have a proper width widening ratio, in order that the relationship between the length H1 (mm) of the connecting yarn shown in FIG. 3, which is a cross-section of the three-dimensional knit fabric 1 taken along the course thereof, and the length H2 (mm) of the connecting yarn when the three-dimensional knit fabric is compressed to 50%, as shown in FIG. 4, preferably satisfies the following equation for achieving a bending elongation of 20% or less when the three-dimensional knit fabric 1 is compressed to 50%:

$$H1/H2 \geqq 0.55$$

wherein the length H1 is obtained by subtracting the total thickness of the front and back knit layers from the thickness $T_0$ (mm) of the three-dimensional knit fabric 1 as shown in FIG. 3. In this regard, the lengths H1 and H2 are apparent lengths of the connecting yarn 4 disposed between the front knit layer 2 and the back knit layer 3 as seen in FIGS. 3 and 4 in the cross-section of the three-dimensional knit fabric 1 taken along a course thereof, and measured from a photograph of the fabric cross-section along the course.

When the connecting yarn is slanted in the direction along the course, the adjacent connecting yarn is preferably slanted in reverse to the preceding connecting yarn so that a truss structure or a cross structure is obtained as described later.

The ratio of the number of monofilament yarn having a curvature in a range from 0.01 to 1.6 and the bending elongation of 20% or less when compressed to 50% relative to a total number of the monofilament connecting yarn in the three-dimensional knit fabric is necessarily 20% or more, preferably 40% or more, most preferably 60% or more.

While all the connecting yarn in the three-dimensional knit fabric is preferably monofilament yarn, other yarns than the monofilament yarn may be mixed if necessary when the fabric is knit. For example, if multifilament false-twist textured yarns or others are mixedly knit, unpleasant sound generated due to the rubbing of the monofilament yarns are reduced when the fabric is compressed.

To reduce the hysteresis loss to 50% or less when the fabric is compressed to 50%, it is important to properly select or control the thickness of the three-dimensional knit fabric, the diameter of the monofilament yarn, the slant state of the monofilament yarn or others so that the bending elongation of the monofilament connecting yarn is 20% or less. In addition, a monofilament yarn having a hysteresis loss during the recovery of 0.05 cN·cm/yarn or less is preferably used as a connecting yarn, more preferably 0.03 cN·cm/yarn or less, most preferably 0.01 cN·cm/yarn or less, which value is ideally as close as possible to zero. The relationship between the diameter D (mm) of the monofilament yarn and the thickness $T_0$ (mm) of the three-dimensional knit fabric preferably satisfies the following equation:

$$T_0/D \geqq 20$$

wherein the thickness $T_0$ (mm) of the three-dimensional knit fabric is the thickness measured under a load of 490 Pa.

The three-dimensional knit fabric preferably has a percentage of stress relaxation from the 50% compression that is 40% or less after one minutes, more preferably 30% or less. If the stress relaxation is less than 40%, instantaneous recovery is facilitated even if a user has been sitting for a certain period on the three-dimensional knit fabric.

When the three-dimensional knit fabric according to the present invention is used for a hammock type seat, the compressive deformation is preferably in the range from 10 to 80 mm because the user feels fit well with such a fabric when seated thereon. The hammock type seat referred to herein is one in which the three-dimensional knit fabric forms a seat portion or a back portion by attaching the three-dimensional knit fabric to a seat frame or a frame work of a chair in a tensed or slackened state around the entire periphery or at least two edges thereof.

The compressive deformation is the amount of strain of a rectangular piece of the three-dimensional knit fabric fixed to a frame along the periphery thereof when a vertical load is applied to the surface of the fabric piece, which value depends largely on the stretching characteristic of the front and back knit layers of the three-dimensional knit fabric. If the compressive deformation is less than 10 mm, the amount of depressive sinking when a person sit down is excessively small whereby the three-dimensional knit fabric forming the seat surface does not conform to the human body making the sitting person feel hard and uncomfortable to sit on. Contrarily, the comfortable feel to sit on is obtained if the compressive deformation exceeds 80 mm. However, the shape-retaining property of the knitted fabric becomes unsatisfactory for the reason that the fabric become deformed (depressed) to a degree in which the original shape of the fabric is not recovered after compression of sitting being released. The compressive deformation is more preferably in a range from 15 to 70 mm, most preferably from 15 to 60 mm.

To maintain compressive deformation in a proper range, the elongation characteristic of the three-dimensional knit fabric both in the longitudinal direction (along the wale) and the transverse direction (along the course) and the compressive characteristic in the thickness direction are important. The three-dimensional knit fabric according to the present invention preferably has longitudinal and transverse elongation in a range from 3 to 50% for the purpose of obtaining a hammock type seat capable of relatively large compressive sinking of a sitting human body therein and improved in conformability to the sitting human body. More preferably, this value is in a range from 5 to 45%. To obtain a hammock type seat imparting the user with a relatively large bouncing feel and having the favorable shape-retaining property with minimized deformation (depression) of the fabric after being seated by the user, the longitudinal and transverse elongation is preferably in a range from 0.5 to 20%, more preferably from 1 to 15%.

In this respect, the longitudinal and transverse directional residual strain when the three-dimensional knit fabric is stretched is preferably 10% or less in order to minimize permanent deformation of the hammock type seat after being used, more preferably 7% or less, most preferably 5% or less. To maintain longitudinal and transverse directional elongation and residual strain in a proper range, the knitting stitch of front and back knit layers in the three-dimensional knit fabric and the method of finishing the fabric are important. If the front and back knit layers are formed of a porous knit stitch such as a mesh, the number of stitched loops forming one mesh (the number of courses) is preferably 12 or less, and the knit fabric is preferably heat-set in the finishing method to increase the width in the transverse direction while taking a balance of elongation between the longitudinal and transverse directions into considerations. If at least one of the front and back knit layers is formed of a non-porous knit stitch such as a flat knit or a rib knit, a knit stitch in which all courses are formed of knitted loops or a composite stitch of a knitted loop stitch and an insert stitch may be adopted. To obtain a desirable cushioning property in the hammock type seat improved in plushiness and good fit with the human body, the elongation of the three-dimensional knit fabric must be relatively large. To do so, insert stitch in which no knitted loop is formed in all the courses is not desirable, but adoption of a knit stitch in which knitted loops are formed in at least a half of courses is preferred. To obtain a hammock type seat with bouncy cushioning property and shape-retaining property even after repeated or for long-time use, preferably, inlaid yarns are linearly inserted into at least one of front and back knit layers in the longitudinal and/or transverse direction so that the elongation of the three-dimensional knit fabric is relatively small. By linearly inserting the inlaid yarns in the longitudinal and/or transverse direction, the longitudinal and/or transverse directional elongation characteristic of the three-dimensional knit fabric is not affected by the deformation of the knitted loops in the front and back knit layers or the change of the mesh shape, but is determined solely by the elongation characteristic of the inlaid yarn itself. In other words, when the user sits on the hammock type seat, thereby applying an external force on a surface of the three-dimensional knit fabric generally in the vertical direction, and stretching the front and back knit layers, interfiber displacements due to deformation of a loop shape or a mesh shape is prevented, and thus the shape-retaining property is maintained even after the seat has been used repeatedly or for a long time. In this respect, in a case of the longitudinal direction, the state in which the inlaid yarn is linearly inserted in at least one of the front and back knit layers is one in which the inlaid yarn is inserted between a needle loop and a sinker loop of a ground yarn knitted in a chain stitch or a dembigh stitch or others at a shogging width of two needles or less per course, or the inlaid yarn is substantially linearly inserted along the total length of the three-dimensional knit fabric while shifting up and down between sinker loops of a ground yarn running in the lengthwise direction of the three-dimensional knit fabric. While, in a case of the transverse direction, a state corresponding to the above is one in which the inlaid yarn is substantially linearly inserted along the total width of the three-dimensional knit fabric between needle loops and sinker loops of a ground yarn knitted in a chain stitch, a dembigh stitch or others. In these cases, as the inlaid yarn, a fiber having a favorable elastic recovery such as polytrimethylene terephthalate fiber or polyester type elastomeric fiber is preferably used. In particular, a monofilament type yarn is suitable because its elongation recovery is not affected by frictional resistance between single fibers. Also, the inlaid yarn is preferably bonded to the ground yarn by fusion bonding or resin-adhesion.

If the inlaid yarn is inserted in the longitudinal direction, the insertion may be carried out in any knitting stitch, while if it is inserted in the transverse direction, the inlaid yarn may be inserted as a weft by a double raschel knitting machine provided with a weft inserting device.

It is not necessary for the front and back knit layers to be identical; they may be different in terms of knitting stitch or elongation characteristic. In this regard, the elongation of the back knit layer is preferably less than that of the front knit layer, because the springy feel obtained by the use of the monofilament become more pronounced when the user sits on a seat whereby the knit fabric become fit well with a human body. When the inlaid yarn is inserted both in the longitudinal and transverse directions, it is preferably inserted in the back knit layer of the three-dimensional knit fabric.

Preferably, the hysteresis loss during the compressive deformation of the three-dimensional knit fabric is 65% or less when compressed, because the cushioning property becomes pronounced in bouncing feel when used in a hammock type seat, which value is more preferably 60% or less, most preferably 50% or less, ideally as close as possible to zero. The residual strain during the compressive deformation of the three-dimensional knit fabric when compressed is preferably 30 mm or less, because the shape-retaining property is improved after it has been used repeatedly or for a long time, more preferably 20% or less, most preferably 15% or less, ideally as close as possible to zero.

It is possible to minimize the hysteresis loss and the residual strain during the compressive deformation of the three-dimensional knit fabric when compressed, by heat treating the fibers constituting the front and back knit layers while stretching them at an elongation of 0% or more. The heat treatment may be carried out at an under-feed rate in a raw yarn production stage or a yarn processing stage such as a false-twist or fluid jet texturing process, or after the yarn has been knit into a fabric, the knit fabric may be heat-treated in a stretched state. When heat-treating the fabric in a stretched state, it is preferably stretched at 5% or more in the widthwise direction.

In addition, the three-dimensional knit fabric according to the present invention preferably has a compression recovery of 90% or more at normal temperature, and 70% or more in an atmosphere at 70° C. More preferably, the compression recovery is 95% or more at normal temperature, and 75% or more in an atmosphere at 70° C. If the compression recovery is 90% or more at normal temperature, the three-dimensional knit fabric maintains a favorable cushioning property free from residual strain during normal use. If the compression recovery is 70% or more in an atmosphere at 70° C., the three-dimensional knit fabric maintains a favorable cushioning property free from residual strain even in a hot and severe environment.

The monofilament yarn used as a connecting yarn for the three-dimensional knit fabric according to the present invention includes polytrimethylene terephthalate fiber, polybutylene terephthalate fiber, polyethylene terephthalate fiber, polyamide fiber, polypropylene fiber, polyvinyl chloride fiber, polyester type elastomeric fiber or others. Of them, the polytrimethylene terephthalate fiber is preferably used as at least part of the connecting yarn, because cushioning property in springy feel can be obtained and maintained even after the three-dimensional knit fabric has been compressed repeatedly or for a long time. Fiber used for the front or back knit layer of the three-dimensional knit fabric includes synthetic fiber such as polyester type fiber including polyethylene terephthalate fiber, polytrimethylene terephthalate fiber or polybutylene terephthalate fiber, polyamide type fiber, polyacrylic type fiber or polypropylene type fiber; natural fiber such as cotton, ramie or wool; and regenerated fiber such as cuprammonium rayon, viscose rayon or Lyocel and the like. Of them, the polytrimethylene terephthalate fiber is preferable, because the compressive deformation can be increased when the three-dimensional knit fabric is used for a hammock type seat, resulting in improvement of stroke feel (plushy feel) and fit feel. Further, the polytrimethylene terephthalate fiber is preferably heat-treated in a stretched state at a stretching ratio of 0% or more in a raw yarn production stage or a yarn processing stage, or after the yarn has been knit into a fabric for the purpose of minimizing hysteresis loss and residual strain during compressive deformation. The knit fabric is heat-treated in a stretched state more preferably at a width-widening ratio of 5% or more. The cross-section of the fiber may be circular, triangular, an L-shape, a T-shape, a Y-shape, a W-shape, octagonal, flat, a dog-bone shape, an indefinite shape or a hollow shape. The fiber may be provided as a green yarn, a spun yarn, a twisted yarn, a false-twist textured yarn or a fluid jet textured yarn. The fiber may be provided as a monofilament yarn or a multifilament yarn. To sufficiently cover a monofilament connecting yarn so as for it not to be exposed in the surface of the knit fabric, the false-twist textured multifilament yarn or the spun yarn is preferably used in at least one of the knit layers of the three-dimensional knit fabric. To impart the three-dimensional knit fabric with powerful stretchability, compressive deformation and recovery, the monofilament yarn is preferably used in at least one of the knit layers of the three-dimensional knit fabric. In this regard, the monofilament yarn is preferably a composite fiber of a side-by-side type or others for the purpose of facilitating stretchability and stretch recovery. Yarns constituting the front and back knit layers and the connecting yarn are preferably formed of 100% polyester type fibers, because a recycling system in which discarded fabric is decomposed to a monomer through the depolymerization process can be established and no toxic gas is generated if it is incinerated.

The polytrimethylene terephthalate fiber suitably used in the present invention is a polyester type fiber comprised of trimethylene terephthalate units as main repeating units, containing trimethylene terephthalate units of 50 mol % or more, preferably 70 mol % or more, more preferably 80 mol % or more, most preferably 90 mol % or more. This fiber may contain, as a third component, other acidic components and/or glycolic components of 50 mol % or less as a total amount, preferably 30 mol % or less, more preferably 20 mol % or less, most preferably 10 mol % or less.

The polytrimethylene terephthalate may be synthesized by binding terephthalic acid or a functional derivative thereof with trimethylene glycol or a functional derivative thereof in the presence of a catalyst under suitable reaction conditions. In this synthesis process, one or two kinds or more of third components may be added to be a polyester copolymer. Alternatively, a polyester other than the polytrimethylene terephthalate prepared separately therefrom, such as polyethylene terephthalate or polybutylene terephthalate, or nylon may be blended or combined with the polytrimethylene terephthalate to obtain a composite fiber (of a sheath-core type or a side-by-side type).

Japanese Examined Patent Publication (Kokoku) No. 43-19108, Japanese Unexamined Patent Publication (Kokai) Nos. 11-189923, 2000-239927 and 2000-256918 disclose a composite fiber spinning technique in which the polytrimethylene terephthalate is used as a first component, and a polyester such as another polytrimethylene terephthalate, polyethylene terephthalate or polybutylene terephthalate or nylon is used as a second component, which components are arranged in parallel to each other to form a side-by-side type fiber, or in an eccentric sheath/core manner to form an eccentric sheath-core type fiber. In particular, the combination of polytrimethylene terephthalate and polytrimethylene terephthalate copolymer or the combination of two kinds of polytrimethylene terephthalate different in intrinsic viscosity is favorable. Of them, the composite fiber obtained from the latter combination is preferably used for forming the front and back knit layers, in which a boundary between the two components in the cross-section of the resultant side-by-side type composite fiber is curved so that the lower viscosity polymer encircles the higher viscosity polymer because such a composite fiber has high stretch recovery, as disclosed in Japanese Unexamined Patent Publication No. 2000-239927.

The third component added to the main components includes aliphatic dicarbonate (such as oxalic acid or adipic acid), alicyclic dicarbonate (such as cyclohexane dicarbonate), aromatic dicarbonate (such as isophthalic acid or sodium sulfoisophthalate), aliphatic glycol (such as ethylene glycol, 1,2-propylene glycol or tetramethylene glycol), alicyclic glycol (such as cyclohexanedimethanol), aliphatic glycol containing aromatic group (such as 1,4-bis (β-hydroxyethoxy) benzene), polyether glycol (such as polyethylene glycol or polypropylene glycol), aliphatic oxicarbonate (such as ω-oxicaproate), and aromatic oxicarbonate (such as P-oxibenzoate). Also, compounds having one or three or more ester-forming functional groups (such as benzoic acid or glycerin) may be used within a range in which the polymer is substantially linear.

Further, the following may be contained; a delusterant such as titanium dioxide, a stabilizer such as phosphoric acid, an ultraviolet absorber such as hydroxybenzophenone derivative, a crystallization neucleator such as talc, a lubricant such as aerozil, an antioxidant such as hindered phenol derivative, a flame retardant, an antistatic agent, a pigment, a fluorescent brightening agent, an infrared absorber or an anti-foaming agent.

Monofilaments of the polytrimethylene terephthalate fiber may be produced, for example, by a method disclosed in Japanese Patent Application No. 2000-93724. Specifically, the polytrimethylene terephthalate extruded from a spinneret is taken up by a first roll after being quickly cooled in a quenching bath. Then, it is wound by a second roll while being drawn in a hot water bath or in a dry heat atmosphere, after which it is relaxed at an overfeed rate in a dry heat or wet heat atmosphere and finally wound by a third roll. The cross-section of the fiber may be circular, triangular, an L-shape, a T-shape, a Y-shape, a W-shape, octagonal, flat, a dog-bone shape, an indefinite shape or a hollow shape. Of them, the circular cross-section is preferable because it facilitates the durability of the cushioning property of the three-dimensional knit fabric.

The fiber used for forming the front and back knit layers or the monofilament for the connecting yarn is preferably colored. The coloring method may include yarn dyeing in which undyed yarn is dyed in a form of a hank or a cheese, dope dyeing in which pigment or dye is mixed with a dope prior to being spun into fiber, and fabric dyeing or a printing in which the dyeing is carried out on a three-dimensional knit fabric. However, since use of the last-mentioned method carried out on the knit fabric makes it difficult to maintain a three-dimensional shape or has inferior processability, yarn dyeing or cheese dyeing is preferable.

The fiber size of the monofilament used for the connecting yarn is usually in a range from 20 to 1500 dtex. For the purpose of imparting the three-dimensional knit fabric with excellent cushioning property in springy feel, the fiber size of the monofilament is preferably in a range from 100 to 1000 dtex, more preferably from 200 to 900 dtex. Yarn such as a multifilament yarn used for forming the front and back knit layers may usually have a fiber size in a range from 50 to 2500 dtex, and the number of filaments may be optionally selected. At this time, the ratio of a fiber size T (dtex) of the monofilament to a fiber size d (dtex) of all the multifilaments hooked to a single needle of a knitting machine is preferably $T/d \geqq 0.9$. If this relationship is maintained, it is possible for the multifilament to cover the monofilament and prevent the latter from being exposed in the surface of the three-dimensional knit fabric, whereby the glossiness of the surface of the three-dimensional knit fabric due to the luster inherent to the monofilament can be suppressed, and this embodiment is preferred to improve the hand of the fabric surface.

The three-dimensional knit fabric of the present invention can be knit by a knitting machine having double needle beds disposed opposite to each other, such as a double raschel knitting machine, a double circular knitting machine or a flat knitting machine with a V-shaped bed. Of them, the double raschel knitting machine is preferably used for obtaining a three-dimensional knit fabric having good dimensional stability. The gauge of the knitting machine is preferably in a range from 9 to 28 gauge.

To reduce the basis weight of the knit fabric and facilitate air-permeability, the knit fabric may be a mesh fabric having square or hexagonal mesh patterns or a marquisette fabric having a plurality of openings, or to improve the touch to the skin, the knit fabric may have a flat structure on the outer surface. If the fabric surface is raised, the touch to the skin is more improved.

The arrangement density of the connecting yarn is such that when the number of connecting yarns in a 2.54 cm square of the three-dimensional knit fabric is N (end/2.54 cm square), dtex of the connecting yarn is T ($g/l \times 10^6$ cm) and the specific weight of the connecting yarn is $\rho_0$ ($g/cm^3$), the total cross-sectional area ($N \cdot T/l \times 10^6 \rho_0$) of the connecting yarn in a 2.54 cm square of the three-dimensional knit fabric is preferably in a range from 0.03 to 0.35 $cm^2$, more preferably from 0.05 to 0.25 $cm^2$. By maintaining the total cross-sectional area within this range, the three-dimensional knit fabric has a favorable cushioning property provided with suitable rigidity.

Figure 5:
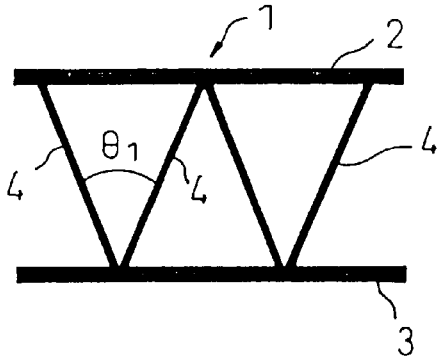
FIG. 5 is a sectional view of a three-dimensional knit fabric taken along a course thereof, illustrating a truss structure of a connecting yarn.
Figure 6:
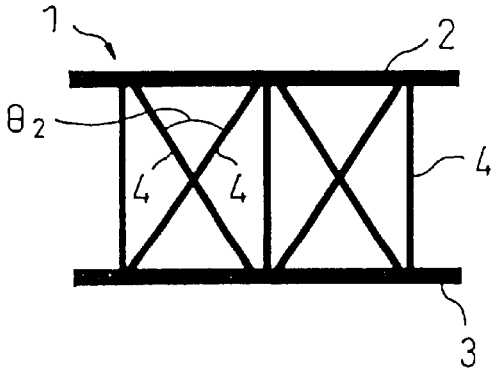
FIG. 6 is a sectional view of a three-dimensional knit fabric taken along a course thereof, illustrating a cross structure of a connecting yarn.

While the connecting yarn either forms knitted loops in the front and back knit layers or is simply inlaid in the front and back knit layers, it is preferable that at least two connecting yarns connect the front and back knit layers with each other while slanted in the opposite directions to each other so that a cross (X-shaped) or truss structure is formed for facilitating the form-retaining property of the three-dimensional knit fabric. In the truss structure, as shown in FIG. 5 illustrating a cross-section of the knit fabric 1 taken along the course, an angle $\theta_1$ made by two connecting yarns 4, 4 is preferably in a range from 40 to 160 degrees so that the form-retaining property is facilitated. In the cross structure, as shown in FIG. 6 illustrating a cross-section of the knit fabric 1 taken along the course, an angle $\theta_2$ made by two connecting yarns 4, 4 is preferably in a range from 15 to 150 degrees. Both in the truss structure and cross structure, the two connecting yarns may be a single yarn which returns back from the front or back knit layer to the other layer as if the fabric were knitted using two yarns. The truss or cross structure may not be formed in the same course but may be formed in different courses apart from each other within five courses.

The thickness and basis weight of the three-dimensional knit fabric may be optionally selected in accordance with the use thereof. The thickness is preferably in a range from 3 to 30 mm. If it is less than 3 mm, the cushioning property becomes lower. If it exceeds 30 mm, finishing treatment of the three-dimensional knit fabric become difficult. The basis weight is in a range from 150 to 3000 $g/m^2$, preferably from 200 to 2000 $g/m^2$.

If the three-dimensional knit fabric is formed of a yarn-dyed yarn or a dope-dyed yarn, the fabric can be finished through processes for the conventional process for scouring and heat-setting a grey fabric. If a three-dimensional knit fabric is formed of a non-colored yarn either in a connecting yarn or front and back knit layer yarns, a grey fabric may be finished through scouring, dyeing and heat-setting processes or others.

The finished three-dimensional knit fabric may be used for various applications such as a hammock type seat or a bed pad after being treated to have desired shapes through means for fusion-bonding, sewing or resin-treating the edges thereof or through a heat-forming process.

BEST MODE FOR CARRYING OUT THE INVENTION

The present invention will be more concretely described below with reference to the preferred embodiments. It should be noted, however, that the present invention is not limited to the embodiments described herein.

Physical properties of the three-dimensional knit fabric are measured as follows:

(1) Curvature $C_1$ of Monofilament Yarn

An enlarged photograph illustrating a curved state of a monofilament of the connecting yarn for the three-dimensional knit fabric is taken, as seen in the direction vertical to an arc (a semicircle) formed by the curved monofilament. In this case, if the connecting yarn is slanted, the photograph is taken to match the inclination angle. The enlarged photograph thus taken is read by an image scanner and stored in a computer, which data are analyzed while using a high precision video analyzing system IPI 000PC (trade name; ASAHI KASEI (K.K.)) to depict an inscribed circle (on a concave side of the monofilament) and a circumscribed circle (on a convex side of the monofilament) defined by the most sharply curved portion of the monofilament, from which average values of radius of the respective circles (values converted to the absolute size) are then calculated. Based on these values, a radius of curvature $r_1$ (mm) relative to a center line of the monofilament is determined and the curvature is calculated by the following equation:

$$C_1=1/r_1$$

(2) Bending Elongation S (%) of Monofilament

A thickness $T_0$ (mm) of the three-dimensional knit fabric is measured under a load of 490 Pa, and an enlarged photograph of the three-dimensional knit fabric compressed to have a thickness of $T_0/2$ (mm) is taken to represent a curved state of the monofilament as seen in the direction vertical to an arc (a semicircle) formed by the curved monofilament. The enlarged photograph thus taken is read by an image scanner and stored in a computer, which data are analyzed in the same manner as before to obtain a radius of curvature $r_2$ (mm) of an arc defined by a center line in a most sharply curved portion of the monofilament, from which a bending elongation S (%) is calculated by the following equation:

$$S(\%)=50D/r_2$$

wherein D represents the diameter of the monofilament. In this regard, when the enlarged photograph of the three-dimensional knit fabric compressed to 50% is taken, the slanted monofilament can also be easily taken from the monofilament curved and jutting out from an end of the three-dimensional knit fabric on the knit-entanglement side thereof when compressed to 50%. Alternatively, to enhance the photographing operation, the three-dimensional knit fabric may be hardened with resin at the 50% compressed state.

(3) Hysteresis Loss L (%) During Recovery from 50% Compression

Figure 7:
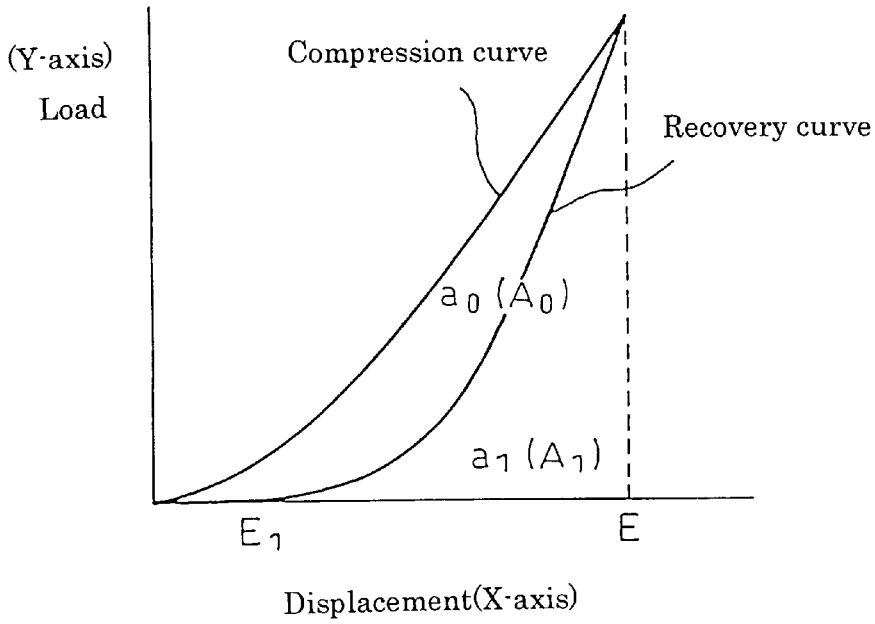
FIG. 7 is one example of a stress-strain curve of the three-dimensional knit fabric.

By using the Shimadzu autograph AG-B type (manufactured by SHIMADZU SEISAKUSHO), a 15 cm square piece of the three-dimensional knit fabric having a thickness $T_0$ (mm) placed on a rigid surface is compressed with a disk-like compressing jig of 100 mm diameter to a thickness T/2 at a speed of 10 mm/min, and directly after reaching the predetermined thickness, the compression is released at a speed of 10 mm/min. From a stress-strain curve of the three-dimensional knit fabric shown in FIG. 7 thus obtained, an area $A_0$ ($cm^2$) defined by a compression curve and a displacement axis (X axis) and an area $A_1$ ($cm^2$) defined by a recovery curve and a displacement axis (X axis) are determined. Therefrom, the hysteresis loss L (%) is calculated by the following equation:

$$L(\%)=\{(A_0-A_1)/A_0\}\times 100$$

(4) Compressive Residual Strain $\epsilon$ (%) After Being Compressed to 50%

The compressive residual strain $\epsilon$ (%) after the three-dimensional knit fabric has been compressed and released as described in (3) is calculated by the following equation:

$$\epsilon(\%)=\{(T_0-T_1)/T_0\}\times 100$$

wherein $T_1$ (mm) represents the thickness of the three-dimensional knit fabric under a load of 490 Pa directly after being released from compression.

(5) Amount of Compressive Deformation E (mm), Hysteresis Loss Q (%) During the Compressive Deformation, and Amount of Residual Deformation $E_1$ The three-dimensional knit fabric is sandwiched in a non-relaxed state between a square plate-like metallic frame with feet of 15 cm high at four corners thereof, having an inner side of 30 cm long and an outer side of 41 cm with a sand paper of #40 being adhere to a upper surface thereof for the purpose preventing sliding and a square plate-like metallic frame having an inner side of 30 cm and an outer side of 41 cm (with sand paper of #40 being adhered to a lower surface thereof for the purpose of preventing slippage), after which the metallic frames are fixed to each other by a vise.

By using the Shimadzu autograph AG-B type (manufactured by SHIMADZU SEISAKUSHO), a central portion of the three-dimensional knit fabric maintained in a tensed state is compressed with a circular compressive jig of 100 mm diameter at a speed of 100 mm/min, which compressive jig is then returned to the original position at the same speed when a load has reached 245 N. From a stress-strain curve of the three-dimensional knit fabric shown in FIG. 7 obtained in this manner, the amount of compressive deformation E (mm) is defined as the displacement under a load of 245 N, and the amount of residual deformation $E_1$ is defined as the displacement under no load. Also, the hysteresis loss Q (%) is calculated by the following equation from an area $a_0$ ($cm^2$) defined by a compression curve and the displacement axis (X axis) and an area $a_1$ ($cm^2$) defined by a recovery curve and the displacement axis (X axis):

$$Q(\%)=\{(a_0-a_1)/a_0\}\times 100$$

(6) Elongation I (%) and Residual Strain B (%) of Elongation

Test samples are prepared by cutting the finished three-dimensional knit fabric into pieces 30 cm long and 5 cm wide, on which marks are plotted at a distance of 20 cm. The test samples are collected both in the longitudinal direction (along the wale) and the transverse direction (along the course). The test sample is suspended at one end from a chuck and loaded at the other end with a weight so that a force of 30 N is applied thereto. After 5 minutes, the length L1 (cm) between the marks is measured, then the weight is released and the length L2 (cm) between the marks is again measured after 1 minute, from which the elongation and a residual strain are calculated by the following equations:

$$I(\%)=\{(L1-20)/20\}\times 100$$

$$B(\%)=\{(L2-20)/20\}\times 100$$

(7) Compression Recovery R (%)

The three-dimensional knit fabric having a thickness of $T_0$ (mm) is compressed to 50% to a thickness of $T_0/2$ (mm) and left for 22 hours in an atmosphere at normal temperature (23±0.5° C.) and 70° C. (±0.5° C.). After 22 hours, the compression is released and the fabric is left for 30 minutes at normal temperature. Then, the thickness T2 of the three-dimensional knit fabric is measured under a load of 490 Pa, from which the compression recovery R (%) is calculated by the following equation:

$$R(\%)=(T_2/T_0)\times 100$$

(8) Residual Strain ϵ (%) After Repeated Compression

The 50% compression in which the thickness $T_0$ (mm) of the three-dimensional knit fabric is reduced to $T_0/2$ is repeated 250 thousand times by using a repeated compression tester Type A for foam rubber (manufactured by TESTER SANGYO (K.K.)). Thereafter, the thickness $T_3$ (mm) of the fabric is measured under a load of 490 Pa, and the residual strain ϵ (%) after the repeated compression is calculated by the following equation:

$$\epsilon(\%)=\{(T_0-T_3)/T_0\}\times 100$$

(9) Hysteresis Loss 2HB (%) During Bending Recovery of Monofilament 26 monofilaments are arranged parallel to each other in a sheet form at 1 mm pitch, and upper and lower surfaces of the opposite edges of the sheet are fixed with cardboard used as a grip section via a double-coated tape so that a sample length of 11 mm is obtained. The grip section of the respective edge is 20 mm length and 30 mm wide.

By using a pure-bending tester Type KES-FB2 (manufactured by KATOTECH), the sheet-like sample of the monofilaments are bent in the normal and reverse directions to have a curvature of 2.5, and the hysteresis loss 2HB (cN·cm/yarn) during bending recovery is measured at a curvature of 1.

(10) Vibration Damping Property

A 10 cm square piece of the three-dimensional knit fabric is placed on a plate-like vibrating section of a VIBRATION GENERATOR F-300BM/A (manufactured by EMIC K.K.) with a back surface thereof facing downward, and loaded with a 2 Kg cylindrical weight of 100 mm diameter. An acceleration pickup Type 4371 (manufactured by B & K; Germany) is fixed by a magnet and connected to an FFT analyzer Type DS2000 (manufactured by ONO SOKKI K.K.) via an amplifier Type 2692 AOSI (manufactured by B & K; Germany). Output acceleration is measured at a constant displacement of ±1 mm under the condition of an acceleration of 0.1 G, a frequency in a range from 10 to 200 Hz and a sine wave log sweep to result in an acceleration transfer ratio-frequency curve. In such a curve, the frequency at which the acceleration transfer ratio becomes maximum is defined as the resonance frequency, and the acceleration transfer ratio at the resonance frequency and that at 200 Hz are obtained. In this respect, the smaller the acceleration transfer ratio, the better the vibration damping property of the three-dimensional knit fabric.

(11) Cushioning Property (Springiness)

The three-dimensional knit fabric is placed on a table and lightly pressed by fingers (three) from above three times. The elastic feeling is evaluated by a sensory test in accordance with the following criteria both before and after being repeatedly compressed.

◎: high springiness

○: relatively high springiness

Δ: low springiness

X: no discernible springiness

(12) Cushioning Property in Hammock Type Seat (Bounciness, Fit)

The three-dimensional knit fabric is attached to a metallic frame of 40 cm square for a chair (having no back rest) by sewing the periphery of the fabric thereto not in a slackened state and fastening the same with screws. Four chairs are prepared for the test. A man of 65 Kg weight sits on the chair for 5 minutes 10 times, and the cushioning property is evaluated by the sensory test in accordance with the following four criteria:

◎: Bouncy

⊙: slighthy bouncy

Δ: Less bouncy

X: lack in bounciness

On the other hand, the fit feel property is evaluated by the sensory test in accordance with the following four criteria.

◎: the fit feel is high

○: the fit feel is relatively high

Δ: the fit feel is relatively low

X: fit feel is low

(13) Shape-retaining Property in Hammock Type Seat

After the test of (12), the degree of deformation (depression) of the three-dimensional knit fabric attached to the chairs is observed, and evaluation of the shape-retaining property is carried out in accordance with the following criteria:

◎: no deformation is discernible

○: the deformation is hardly discernible

Δ: the deformation is slightly discernible

X: the deformation is significantly discernible

Reference (Preparation of Polytrimethylene Terephthalate Monofilament)

Polytrimethylene terephthalate monofilament used in the following Examples was produced by the following method:

Polytrimethylene terephthalate of $\eta_{sp/c}$=0.92 (measured by using o-chlorophenol as a solvent at 35° C.) was extruded from a spinneret at a spinning temperature of 265° C., cooled in a quenching bath at 40° C. and drafted by a group of first rolls at a speed of 16.0 m/min to result in an undrawn monofilament yarn, which was then drawn by a group of second rolls in a drawing bath at 55° C. at a draw ratio of 5 times. Thereafter, the yarn was heat-treated in a relaxed state in a steam bath of 120° C., passed through a group of third rolls at a speed of 72.0 m/min, and wound on a winder at the same speed as the group of third rolls to result in a drawn monofilament yarn of 280 dtex. A drawn monofilament yarn of 880 dtex was obtained in a similar manner.

EXAMPLE 1

In a double raschel knitting machine having six guide bars of 18 gauge with a bed gap of 12 mm, polytrimethylene terephthalate false-twist textured yarns of 167 dtex/48 filaments (manufactured by ASAHI KASEI K.K.; a false-twist textured yarn "Solo", cheese-dyed in black color) arranged in an "all-in" manner were supplied from three guide bars (L1, L2 and L3) for knitting a front knit layer, while polytrimethylene terephthalate false-twist textured yarns of 334 dtex/96 filaments (each of which is a two-plied yarn of "Solo" false-twist textured yarn of 167 dtex/48 filaments manufactured by ASAHI KASEI K.K., cheese-dyed in black color) were supplied from two guide bars (L5 and L6) for knitting a back knit layer, which yarns are arranged in a one-in and one-out manner for the guide bar L5 and in a one-out and one-in manner for the guide bar L6. On the other hand, the polytrimethylene terephthalate monofilaments of 280 dtex (having a diameter of 0.16 mm) prepared as described in the above-mentioned REFERENCE and arranged in an all-in manner were supplied from a guide bar L4 for forming a connecting yarn. A grey fabric was knit in accordance with the knit structure described below at a knitting density of 15 courses/2.54 cm, and was dry heat-set while stretching the width by 20% at 150° C. for 2 minutes to obtain a three-dimensional knit fabric including a flat front knit layer and a mesh-like back knit layer, which are connected to each other by the connecting yarn slanted from loops of the respective wale in the front knit layer to loops of one wale in the back knit layer three wales apart from another wale in the back knit layer directly opposite to the former wale in the front layer to form an X structure. Various physical properties of the resultant three-dimensional knit fabric are shown in Table 1.

(Knit Structure)

L1: 2322/1011/

L2: 1011/2322/

L3: 1000/0111/

L4: 1043/6734/

L5: 2210/1123/

L6: 2232/1101/

EXAMPLE 2

The polytrimethylene terephthalate monofilaments of 280 dtex prepared as described in the above-mentioned REFERENCE were continuously heat-treated in a relaxed state by dry heat at 160° C. while further being overfed at a ratio of 3%. The resultant polytrimethylene terephthalate monofilament had a hysteresis loss during bending recovery of 0.002 cN·cm/yarn.

A three-dimensional knit fabric was obtained in the same manner as in Example 1, except that the monofilaments are supplied from the guide bar L4 for forming the connecting yarn. Physical properties thereof are shown in Table 1.

EXAMPLE 3

A grey fabric was obtained in the same manner as in Example 1, except that polyethylene terephthalate false-twist textured yarns of 167 dtex/48 filaments (manufactured by ASAHI KASEI K.K., cheese-dyed in black color) were supplied from three guide bars (L1, L2 and L3) for knitting a front knit layer, while polyethylene terephthalate false-twist textured yarns of 334 dtex/96 filaments (each of which is a two-plied yarn of polyethylene terephthalate false-twist textured yarn of 167 dtex/48 filaments manufactured by ASAHI KASEI K.K., cheese-dyed in black color) were supplied from two guide bars (L5 and L6) for knitting a back knit layer, and was dry heat-set while stretch the a width by 12% at 150° C. for 2 minutes to obtain a three-dimensional knit fabric having various physical properties as shown in Table 1.

EXAMPLE 4

A polybutylene terephthalate monofilament of 280 dtex (manufactured by ASAHI KASEI K.K.) was continuously heat-treated in a relaxed state as in Example 2, and a monofilament yarn having a hysteresis loss during bending recovery of 0.025 cN·cm/yarn was obtained.

A three-dimensional knit fabric was obtained by supplying this monofilament yarn from a guide bar L4 for forming the connecting yarn, which fabric has various physical properties as shown in Table 1.

EXAMPLE 5

In a double raschel knitting machine having six guide bars of 9 gauge with a bed gap of 13 mm, polyethylene terephthalate false-twist textured yarns of 334 dtex/96 filaments (each of which is a two-plied yarn of polyethylene terephthalate false-twist textured yarn of 167 dtex/48 filaments manufactured by ASAHI KASEI K.K., cheese-dyed in black color) arranged in an "all-in" manner were supplied from three guide bars (L1, L2 and L3) for knitting a front knit layer, while polyethylene terephthalate false-twist textured yarns of 1002 dtex/288 filaments (each of which is a six-plied yarn of 167 dtex/48 filaments manufactured by ASAHI KASEI K.K., cheese-dyed in black color) were supplied from the guide bars (L5 and L6) for knitting a back knit layer, which yarns are arranged in a one-in and one-out manner for the guide bar L5 and in a one-out and one-in manner in the guide bar L6. On the other hand, the polytrimethylene terephthalate monofilaments of 880 dtex (having a diameter of 0.29 mm) prepared as described in the above-mentioned REFERENCE and arranged in an all-in manner were supplied from a guide bar L4 for forming a connecting yarn. A grey fabric was knit in accordance with the knit structure described below at a knitting density of 10 courses/2.54 cm in the same manner as in Example 1, except that the knitting structure of the connecting yarn was changed as follows, and was dry heat-set while stretching the width by 10% at 150° C. for 2 minutes to obtain a three-dimensional knit fabric in which the front and back knit layers are connected to each other by the connecting yarn slanted from loops of the respective wale in the front knit layer to loops of one wale in the back knit layer two wales apart from another wale in the back knit layer directly opposite to the former wale in the front layer to form an X structure. Various physical properties of the resultant three-dimensional knit fabric are shown in Table 1.

(Knit Structure)

L4: 1032/4523/

EXAMPLE 6

A three-dimensional knit fabric was obtained in the same manner as in Example 3, except that the bed gap of a double raschel knitting machine was changed to 5 mm and a knitting structure of the connecting yarn was changed as follows, so that the front and back knit layers are connected to each other by the connecting yarn slanted from loops of the respective wale in the front knit layer to loops of one wales in the back knit layer two wales apart from another wale in the back knit layer directly opposite to the former wale in the front layer to form an X structure. Various physical properties of the resultant three-dimensional knit fabric are shown in Table 1.

(Knit Structure)

L4: 1032/4523/

EXAMPLE 7

A three-dimensional knit fabric was obtained in the same manner as in Example 6, except for use of polybutylene terephthalate yarns of 280 dtex continuously heat-treated in a relaxed state as in Example 4. Various physical properties of the resultant three-dimensional knit fabric are shown in Table 1.

EXAMPLE 8

A three-dimensional knit fabric was obtained in the same manner as in Example 1, except that a grey fabric of the three-dimensional knit fabric was subjected to a dry heat treatment while stretching the width thereof at 25%. Various physical properties of the resultant three-dimensional knit fabric are shown in Table 1.

EXAMPLE 9

A three-dimensional knit fabric was obtained by the same manner as in Example 3, except that a grey fabric of the three-dimensional knit fabric was subjected to a dry heat treatment as it was without stretching the width. Various physical properties of the resultant three-dimensional knit fabric are shown in Table 1.

EXAMPLE 10

A three-dimensional knit fabric was obtained by the same manner as in Example 1, except that a grey fabric was subjected to a dry heat treatment as it was without stretching its width. Various physical properties of the resultant three-dimensional knit fabric are shown in Table 1.

EXAMPLE 11

In a double raschel knitting machine having seven guide bars of 18 gauge and a weft inserting device with a bed gap of 13 mm, polyethylene terephthalate false-twist textured yarns of 1002 dtex/288 filaments (each of which is a six-plied yarn of false-twist textured yarn of 167 dtex/48 filaments manufactured by ASAHI KASEI K.K., cheese-dyed in black color) were supplied from two guide bars (L1 and L2) for knitting a front knit layer, while being arranged in an "two-in and two-out" manner for L1 and "two-out and two-in" manner for L2. Polyethylene terephthalate false-twist textured yarns of 501 dtex/144 filaments (each of which is a three-plied yarn of polyethylene terephthalate false-twist textured yarn of 167 dtex/48 filaments manufactured by ASAHI KASEI K.K., cheese-dyed in black color) were arranged in an all-in manner and supplied from two guide bars (L5 and L7) in three guide bars (L5, L6 and L7) for knitting a back knit layer, and polytrimethylene terephthalate false-twist textured yarns of 2004 dtex/576 filaments (each of which is a twelve-plied yarn of polytrimethylene terephthalate false-twist textured yarn "Solo" of 167 dtex/48 filaments manufactured by ASAHI KASEI K.K., cheese-dyed in black color) were supplied from the guide bar L6. On the other hand, the polytrimethylene terephthalate monofilaments of 880 dtex prepared as described in the above-mentioned REFERENCE were supplied from two guide bars (L3 and L4) for forming a connecting yarn while being arranged in an "two-in and two-out" manner for L3 and "two-out and two-in" manner for L4. The inlaid yarns were inserted into the back knit layer from the guide bar L6 in the longitudinal direction, and polytrimethylene terephthalate yarn of 2004 dtex/576 filaments (each of which is a twelve-plied yarn of "Solo" false-twist textured yarns of 167 dtex/48 filaments manufactured by ASAHI KASEI K.K., cheese-dyed in black color) were inserted as weft, in accordance with the knit structure described below. A grey fabric was knit at a knitting density of 12 courses/2.54 cm, and was dry heat-set while keeping its width at 150° C. for 2 minutes to obtain a three-dimensional knit fabric including the back knit layer with inlaid yarns inserted both in the longitudinal and transverse direction, in which the front and back knit layers are connected to each other by the connecting yarn slanted from loops of the respective wale in the front knit layer to loops of one wale in the back knit layer two wales apart from another wale in the back knit layer directly opposite to the former wale in the front layer to form an X structure. Various physical properties of the resultant three-dimensional knit fabric are shown in Table 1. In this regard, when the compressive deformation of the three-dimensional knit fabric is evaluated, the periphery of a test sample thereof is welded so that no slippage occurs in the transverse inlaid yarns.

(Knit Structure)

L1: 4544/2322/1011/3233/

L2: 1011/3232/4544/2322/

L3: 3254/2310/2301/3245/

L4: 2301/3245/3245/2310/

L5: 0001/1110/

L6: 0011/1100/

L7: 1112/1110/

EXAMPLE 12

In Example 11, a three-dimensional knit fabric was obtained in the same manner as in Example 10, except that two-plied yarns of 880 dtex polytrimethylene terephthalate monofilament were used as yarns inserted into the fabric from the guide bar L6 in the longitudinal direction and as yarns inserted as weft. Various physical properties of the resultant three-dimensional knit fabric are shown in Table 1. In this regard, when the compressive deformation of the three-dimensional knit fabric is evaluated, the periphery of a test sample thereof is welded so that no slippage occurs in the transverse inlaid yarns.

EXAMPLE 13

In Example 11, a three-dimensional knit fabric was obtained in the same manner as in Example 10, except that four-plied yarns of 880 dtex polytrimethylene terephthalate monofilament were used as yarns inserted into the fabric from the guide bar L6 in the longitudinal direction and as yarns inserted as weft. Various physical properties of the resultant three-dimensional knit fabric are shown in Table 1. In this regard, when the compressive deformation of the three-dimensional knit fabric is evaluated, the periphery of a test sample thereof is fusion-bonded so that no slippage occurs in the transverse inlaid yarns.

Comparative Example 1

A three-dimensional knit fabric was obtained in the same manner as in Example 6, except that the knit structure of the connecting yarns was changed as described below. Various physical properties thereof are shown in Table 1.

(Knit Structure)

L4: 1010/0101/

Comparative Example 2

A three-dimensional knit fabric was obtained in the same manner as in Comparative example 1, except for use of 280 dtex polybutylene terephthalate yarns continuously heat-treated in a relaxed state as in Example 4. Various physical properties thereof are shown in Table 1.

Comparative Example 3

A three-dimensional knit fabric was obtained in the same manner as in Example 6, except for use of 280 dtex polyethylene terephthalate monofilament (manufactured by ASAHI KASEI K.K.) as a connecting yarn. Various physical properties thereof are shown in Table 1.

Comparative Example 4

A three-dimensional knit fabric was obtained in the same manner as in Example 5, except that the bed gap was changed to 5 mm and the knit structure of the connecting yarn was changed as described below so that all the connecting yarns were slanted from loops of the respective wales in the front knit layer to loops of one wale in the lock knit layer apart one wale from another wale in the back knit layer directly opposite to the former wale in the front layer, thereby forming an X structure. Various physical properties thereof are shown in Table 1.

(Knit Structure)

L4: 1021/2312/

Comparative Example 5

In a double raschel knitting machine having six guide bars of 18 gauge with a bed gap of 12 mm, polyethylene terephthalate false-twist textured yarns of 334 dtex/96 filaments (each of which is a two-plied yarn of a polyethylene terephthalate false-twist textured yarn of 167 dtex/48 filaments manufactured by ASAHI KASEI K.K.; cheese-dyed in black color) were supplied from two guide bars (L1 and L2) for knitting a front knit layer and two guide bars (L5 and L6) for knitting a back knit layer, while arranged in two-in and two-out manner for L1 and L5 and in two-out and two-in manner for L2 and L6, and the polytrimethylene terephthalate monofilaments of 280 dtex (having a diameter of 0.16 mm) prepared as described in the above-mentioned REFERENCE were supplied from two guide bars (L3 and L4) for forming a connecting yarn, while arranged in two-in and two-out manner for L3 and in two-out and two-in manner for L4. A grey fabric was knit in accordance with the knit structure described below at a knitting density of 14 courses/2.54 cm, and was dry heat-set while stretching the width by 40% at 150° C. for 2 minutes to obtain a three-dimensional knit fabric including mesh-like front and back knit layers, which are connected to each other by the connecting yarn slanted from loops of the respective wale in the front knit layer to loops of one wale in the back knit layer two wales apart from another wale in the back knit layer directly opposite to the former wale in the front layer to form an X structure. Various physical properties of the resultant three-dimensional knit fabric are shown in Table 1. The connecting yarns of the obtained three-dimensional knit fabric readily laid flat in the lengthwise direction (along the wale) of the knit fabric.

(Knit Structure)

L1: 4544/2322/1011/3233/

L2: 1011/3233/4544/2322/

L3: 3254/2310/2301/3245/

L4: 2301/3245/3254/2310/

L5: 4423/2210/1132/3345/

L6: 1132/3345/4423/2210/

TABLE 1-1

| | | Example 1 | Example 2 | Example 3 | Example 4 | Example 5 | Example 6 | Example 7 | Example 8 | Example 9 | Example 10 |
|---|---|---|---|---|---|---|---|---|---|---|---|
| Yarn | Front | PTT | PTT | PET | PET | PET | PET | PET | PTT | PET | PTT |
| | Connecting yarn | PTT280 | PTT280 heat-treated | PTT280 | PBT280 heat-treated | PTT880 | PTT280 | PBT280 heat-treated | PTT280 | PTT280 | PTT280 |
| | Back | PTT | PTT | PET | PET | PET | PET | PET | PTT | PET | PTT |
| Properties | Thickness (mm) | 8.6 | 8.8 | 8.2 | 8.1 | 10.3 | 4.0 | 4.0 | 8.4 | 8.4 | 8.8 |
| Curvature of monofilament | | 0.25 | 0.23 | 0.26 | 0.26 | 0.17 | 0.51 | 0.52 | 0.22 | 0.26 | 0.26 |
| Bending elongation of monofilament (%) | Compressed to 50% | 4.7 | 4.6 | 4.9 | 5.4 | 7.5 | 10.2 | 12.1 | 3.8 | 4.8 | 5.0 |
| | Compressed to 75% | 11.0 | 10.7 | 11.5 | 13.2 | 19.1 | 18.7 | 19.5 | 9.5 | 11.2 | 11.9 |
| Bending hysterisis loss of monofilament (%) | | 0.012 | 0.002 | 0.012 | 0.025 | 0.039 | 0.012 | 0.025 | 0.012 | 0.012 | 0.012 |
| Hysteresis loss when compressed to 50% (%) | | 23.5 | 22.4 | 23.9 | 39.8 | 39.2 | 37.2 | 41.7 | 23.4 | 24.3 | 23.9 |
| Residual compressive strain after being compressed to 50% (%) | | 3.9 | 3.2 | 4.2 | 6.1 | 5.1 | 4.8 | 6.3 | 3.9 | 4.3 | 4.0 |
| Amount of compressive deformation (mm) | | 61.3 | 60.2 | 52.1 | 51.8 | 42.6 | 51.4 | 50.7 | 48.6 | 67.3 | 80.5 |
| Hysteresis loss during compressive deformation (%) | | 54.7 | 53.3 | 52.9 | 53.5 | 49.1 | 53.2 | 54.5 | 49.6 | 60.7 | 67.1 |
| Amount of residual deformation during compression (mm) (Compression deformation) | | 18.3 | 17.7 | 16.5 | 18.0 | 14.1 | 18.0 | 18.9 | 14.9 | 26.0 | 31.2 |
| Elongation (%) | Longitudinal direction | 14.1 | 13.8 | 9.5 | 9.1 | 8.5 | 9.6 | 9.3 | 15.3 | 9.3 | 13.9 |
| | Transverse direction | 47.5 | 46.1 | 42.3 | 41.0 | 36.7 | 42.1 | 41.7 | 42.6 | 50.5 | 58.9 |
| Residual strain of elongation (%) | Longitudinal direction | 3.1 | 2.9 | 1.9 | 1.8 | 1.5 | 2.1 | 1.9 | 3.3 | 1.7 | 3.0 |
| | Transverse direction | 8.3 | 8.0 | 6.4 | 6.1 | 4.9 | 6.3 | 6.0 | 6.6 | 11.4 | 15.3 |
| Compression recovery (%) | At normal temperature | 95.3 | 96.3 | 95.5 | 91.0 | 93.2 | 94.0 | 90.8 | 95.7 | 95.1 | 95.0 |
| | In atmosphere of 70° C. | 75.1 | 76.9 | 75.3 | 72.6 | 73.8 | 74.5 | 72.5 | 75.2 | 75.0 | 74.9 |
| Residual strain after being repeatedly compressed (%) | | 4.5 | 4.0 | 4.6 | 6.7 | 6.3 | 6.2 | 7.6 | 4.6 | 4.6 | 4.7 |
| Vibration damping property | Resonance frequency (Hz) | — | — | — | — | — | 60.3 | 63.3 | — | — | — |
| | Resonance | — | — | — | — | — | 13.3 | 12.2 | — | — | — |

TABLE 1-1-continued

| | | Example 1 | Example 2 | Example 3 | Example 4 | Example 5 | Example 6 | Example 7 | Example 8 | Example 9 | Example 10 |
|---|---|---|---|---|---|---|---|---|---|---|---|
| | frequency acceleration transfer ratio (dB) | | | | | | | | | | |
| | 200 Hz acceleration transfer ratio (dB) | — | — | — | — | — | −16.5 | −15.0 | — | — | — |
| Cushioning property (springy feeling) | Prior to repeating compression | ◎ | ◎ | ◎ | ○ | ○ | ○ | Δ | ◎ | ◎ | ◎ |
| | After repeating compression | ◎ | ◎ | ◎ | ○ | ○ | ○ | Δ | ◎ | ◎ | ◎ |
| Cushioning property in hammock type seat | Bounciness | ○ | ○ | ○ | ○ | ◎ | ○ | ○ | ◎ | Δ | X |
| | Fit feel | ◎ | ◎ | ◎ | ◎ | ○ | ○ | ○ | ○ | ◎ | ◎ |
| Shape-retaining property in hammock type seat | | ○ | ○ | ○ | ○ | ○ | ○ | ○ | ○ | Δ | X |

TABLE 1-2

| | | Example 11 | Example 12 | Example 13 | Comparative example 1 | Comparative example 2 | Comparative example 3 | Comparative example 4 | Comparative example 5 |
|---|---|---|---|---|---|---|---|---|---|
| Yarn | Front | PET | PET | PET | PET | PET | PET | PET | PET |
| | Connecting yarn | PTT880 | PTT880 | PTT880 | PTT280 | PBT280 heat-treated | PET280 | PTT880 | PTT280 |
| | Back | PET PTT | PET PTT | PET PTT | PET | PET | PET | PET | PET |
| Properties | Thickness (mm) | 10.2 | 10.0 | 10.2 | 3.8 | 3.9 | 3.9 | 4.1 | 7.0 |
| Curvature of monofilament | | 0.16 | 0.17 | 0.16 | 0.72 | 0.74 | 0.64 | 1.48 | 0.009 |
| Bending elongation of monofilament (%) | Compressed to 50% | 6.6 | 6.8 | 6.6 | 23.3 | 23.5 | 20.2 | 23.7 | 3.9 |
| | Compressed to 75% | 18.5 | 18.9 | 18.4 | 36.4 | 38.0 | 35.7 | 40.2 | 10.1 |
| Bending hysterisis loss of monofilament (%) | | 0.039 | 0.039 | 0.039 | 0.012 | 0.025 | 0.071 | 0.035 | 0.012 |
| Hysteresis loss when compressed to 50% (%) | | 36.8 | 37.0 | 36.7 | 50.2 | 53.3 | 58.4 | 50.4 | 50.4 |
| Residual compressive strain after being compressed to 50% (%) | | 4.5 | 4.6 | 4.5 | 8.0 | 11.3 | 16.8 | 8.1 | 8.4 |
| Amount of compressive deformation (mm) | | 32.7 | 24.9 | 9.7 | 51.7 | 49.9 | 48.6 | 42.0 | 48.7 |
| Hysteresis loss during compressive deformation (%) | | 44.9 | 41.1 | 35.6 | 53.5 | 54.3 | 55.1 | 51.3 | 50.1 |
| Amount of residual deformation during compression (mm) | | 9.8 | 8.5 | 3.8 | 18.3 | 18.6 | 19.1 | 14.6 | 13.0 |
| Elongation (%) | Longitudinal direction | 3.3 | 3.0 | 1.6 | 9.7 | 9.5 | 9.3 | 8.4 | 19.1 |
| | Transverse direction | 2.9 | 2.1 | 0.4 | 41.8 | 41.9 | 41.5 | 37.2 | 23.9 |
| Residual strain of elongation (%) | Longitudinal direction | 0.3 | 0.2 | 0.2 | 2.0 | 1.9 | 1.6 | 1.5 | 2.2 |
| | Transverse direction | 0.2 | 0.1 | 0.1 | 6.0 | 5.9 | 5.8 | 4.7 | 4.0 |
| Compression recovery (%) | At normal temperature | 94.2 | 94.3 | 94.1 | 91.5 | 83.2 | 77.0 | 91.1 | 92.0 |
| | In atmosphere of 70° C. | 74.3 | 74.8 | 74.1 | 71.1 | 69.5 | 60.9 | 73.8 | 72.1 |
| Residual strain after being repeatedly compressed (%) | | 6.2 | 6.3 | 6.0 | 9.9 | 12.4 | 18.5 | 9.4 | 10.9 |
| Vibration damping property | Resonance frequency (Hz) | — | — | — | — | — | 99.2 | — | — |
| | Resonance frequency acceleration | — | — | — | — | — | 13.4 | — | — |

TABLE 1-2-continued

| | | Example 11 | Example 12 | Example 13 | Comparative example 1 | Comparative example 2 | Comparative example 3 | Comparative example 4 | Comparative example 5 |
|---|---|---|---|---|---|---|---|---|---|
| | transfer ratio (dB) | | | | | | | | |
| | 200 Hz acceleration transfer ratio (dB) | — | — | — | — | — | −3.2 | — | — |
| Cushioning property (springy feeling) | Prior to repeating compression | ○ | ○ | ○ | Δ | X | X | Δ | Δ |
| | After repeating compression | ○ | ○ | ○ | X | X | X | Δ | X |
| Cushioning property in hammock type seat | Bounciness | ◎ | ◎ | ◎ | Δ | Δ | Δ | Δ | Δ |
| | Fit feel | ○ | ○ | ○ | Δ | X | X | Δ | Δ |
| Shape-retaining property in hammock type seat | | ◎ | ◎ | ◎ | Δ | Δ | Δ | Δ | Δ |

CAPABILITY OF EXPLOITATION IN INDUSTRY

The three-dimensional knit fabric according to the present invention has a cushioning property rich in elasticity and excellent in instantaneous compression recovery which does not deteriorate even if the fabric has been used repeatedly or for a long time. In particular, if used for a hammock type seat, the fabric exhibits a cushioning property with an excellent bouncing feel and fits well with the human body, as well as a favorable form-retaining property not causing a deformation (depression) even after the fabric has been used repeatedly or for a long time. Further, the three-dimensional knit fabric according to the present invention has a favorable vibration damping property and therefore is suitable for use as a cushion material for a seat used under circumstances involving vibration, such as a vehicle seat.

What is claimed is:

1. A three-dimensional knit fabric comprising front and back knit layers and a monofilament yarn connecting the knit layers to each other, wherein a curvature of the monofilament yarn in the three-dimensional knit fabric is in a range from 0.01 to 1.6, and a bending elongation of the monofilament yarn is 20% or less when the three-dimensional knit fabric is compressed to 50%.

2. A three-dimensional knit fabric as defined by claim 1, wherein hysteresis loss is 50% or less during recovery of the three-dimensional knit fabric from the 50% compression.

3. A three-dimensional knit fabric as defined by claim 1 or 2, wherein the amount of compressive deformation of the three-dimensional knit fabric is in a range from 10 to 80 mm, hysteresis loss during the compressive deformation is 65% or less, and residual strain during the compressive deformation is 30 mm or less.

4. A three-dimensional knit fabric as defined by claim 1 or 2, wherein an elongation of the three-dimensional knit fabric is in a range from 3 to 50% in longitudinal and transverse directions.

5. A three-dimensional knit fabric as defined by claim 1 or 2, wherein an elongation of the three-dimensional knit fabric is in a range from 0.5 to 20% in longitudinal and transverse directions.

6. A three-dimensional knit fabric as defined by claim 1 or 2, wherein a residual strain of an elongation of the three-dimensional knit fabric is 10% or less in longitudinal and transverse directions.

7. A three-dimensional knit fabric as defined by claim 1 or 2, wherein the bending elongation of the monofilament yarn is 20% or less when the three-dimensional knit fabric is compressed to 75%.

8. A three-dimensional knit fabric as defined by claim 1 or 2, wherein a relationship between a length H1 (mm) of the monofilament yarn before the three-dimensional knit fabric is compressed and a length H2 (mm) of the monofilament yarn after the three-dimensional knit fabric is compressed to 50% is represented by the following equation:

$$H1/H2 \geqq 0.55.$$

9. A three-dimensional knit fabric as defined by claim 1 or 2, wherein a relationship between a diameter D (mm) of the monofilament yarn in the three-dimensional knit fabric and a thickness $T_0$ (mm) of the fabric is represented by the following equation:

$$T_0/D \geqq 20.$$

10. A three-dimensional knit fabric as defined by claim 1 or 2, wherein at least part of the monofilament yarn in the three-dimensional knit fabric connects loops in one wale of the front knit layer in a slanted manner to loops in one wale of the back knit layer apart from another wale of the latter directly opposite to said wale of the front knit layer, and another part of the monofilament yarn connects the knit layers with each other while slanted in reverse to the former part of the monofilament yarn, whereby the parts of monofilament yarn slanted in reverse to each other constitute a cross structure or a truss structure.

11. A three-dimensional knit fabric as defined by claim 1 or 2, wherein a total cross-sectional area of monofilament yarn in a 2.54 cm square of the three-dimensional knit fabric is in a range from 0.03 to 0.35 $cm^2$.

12. A three-dimensional knit fabric as defined by claim 1 or 2, wherein an inlaid yarn is linearly inserted into at least one of the front and back knit layers of the three-dimensional knit fabric.

13. A three-dimensional knit fabric as defined by claim 1 or 2, wherein a compression recovery of the three-dimensional knit fabric is 90% or more at normal temperature and 70% or more in a 70° C. atmosphere.

14. A three-dimensional knit fabric as defined by claim 1 or 2, wherein at least part of the monofilament yarn of the three-dimensional knit fabric is constituted by polytrimethylene terephthalate monofilament.

15. A three-dimensional knit fabric as defined by claim 1 or 2, wherein at least part of a yarn for forming the front and back knit layers of the three-dimensional knit fabric is constituted by polytrimethylene terephthalate multifilament.

16. A three-dimensional knit fabric as defined by claim 12, wherein at least part of the inlaid yarn is constituted by polytrimethylene terephthalate multifilament.

* * * * *